United States Patent [19]

Vanderhoof

[11] Patent Number: 4,637,609

[45] Date of Patent: Jan. 20, 1987

[54] METHOD FOR A GAME

[76] Inventor: John R. Vanderhoof, 200 E. 36th St., New York, N.Y. 10016

[21] Appl. No.: 840,665

[22] Filed: Mar. 18, 1986

Related U.S. Application Data

[60] Division of Ser. No. 652,223, Sep. 18, 1984, Pat. No. 4,591,161, which is a continuation of Ser. No. 404,410, Aug. 2, 1982, abandoned.

[51] Int. Cl.[4] ..... A63F 3/00

[52] U.S. Cl. ..... 273/272

[58] Field of Search ..... 273/240, 272

[56] References Cited

U.S. PATENT DOCUMENTS

| | | | |
|---|---|---|---|
| 3,117,789 | 1/1964 | Wiebe | 273/272 |
| 3,472,514 | 10/1969 | Green | 273/272 |
| 3,565,439 | 2/1971 | Krouse | 273/272 |
| 3,606,336 | 9/1971 | Krause | 273/272 |
| 3,844,568 | 10/1974 | Armstrong | 273/272 |
| 4,014,548 | 3/1977 | Trilling | 273/272 |

FOREIGN PATENT DOCUMENTS

| | | | |
|---|---|---|---|
| 908792 | 10/1962 | United Kingdom | 273/272 |

*Primary Examiner*—Harland S. Skogquist
*Attorney, Agent, or Firm*—Darby & Darby

[57] ABSTRACT

A method and apparatus for a game is disclosed in which a plurality of word-building structures, each having a plurality of playing spaces, are disposed about a gameboard. The preferred word-building structure comprises a pyramid shaped grid having 49 playing spaces. The pyramid is arranged in seven rows, with thirteen playing spaces in the base row and two less playing spaces in each succeedingly higher row.

A word-building structure is associated with each respective competitor, as well as a color-coded set of playing pieces containing alphanumeric characters. These pieces are used by each competitor for building words in the horizontal, vertical, and diagonal directions in his respective word-building structure during a three minute word-building phase. The game board is then rotated to place each competitor in front of an opponent's word-building structure for an offensive phase, during which a competitor may strategically place his playing pieces to block selected spaces adjacent previously built words on an opponent's structure, thereby limiting the opponent's use of the blocked spaces in subsequent word-building phases and capturing the scoring value of the blocked words. Play continues with alternating word-building phases and offensive phases until one of a set of predetermined conditions occurs. Scores are tallied at the end of a game, at which time the point values of words are determined and the final determination of their ownership is made.

31 Claims, 10 Drawing Figures

METHOD FOR A GAME

This is a division of application Ser. No. 652,223, filed Sept. 8, 1984 now U.S. Pat. No. 4,591,161 which is a continuation of application Ser. No. 404,410 filed 8-2-82, now abandoned.

BACKGROUND OF THE INVENTION

This invention relates to the field of games in general, and especially to a method and apparatus for playing a word game and a device and packaging system for use with a folding gameboard for the game.

Various word games are known in the prior art which use playing pieces bearing letters of the alphabet to fill in the interconnected words of a predetermined word-building structure, as in cross-word puzzles. These games have served as a basis for a variety of competitive word games in which two or more people take turns at creating an interconnected word structure with randomly chosen letters, as in "Scrabble" TM.

One of the disadvantages to prior art word games is that they are not conducive to fast paced competition between the players, or competitors. In Scrabble TM, for instance, game pace is restricted because each player takes an active role only when he takes his turn at word building; the remaining time he is essentially inactive. Furthermore, word development is restricted because words may only be arranged side by side if their neighboring letters form completed words, either in the horizontal or vertical directions. Also, competition is very limited in this game, because it is not possible to make aggressive moves against an opponent.

Other word games have been devised which allow competitors to work simultaneously in order to promote fast paced word formation. However these games generally have a limited word-building capability, thus sacrificing some of the game's potential educational qualities in favor of maintaining player interest. One example of this type of game is Boggle TM, in which letters arranged at random on a four by four square matrix format are analyzed simultaneously by the competitors in a limited time period to determine what words have been formed in various directions of the matrix. While this timed competition may add a level of excitement not found in other prior art word games, it prevents the competitors from developing words which exceed four letters in length.

Furthermore, none of the above-mentioned games incorporate a high degree of offensive or aggressive strategy, because the game structure requires continuous tallying of scores and does not provide for reduction of a competitor's score based on his opponent's subsequent offensive maneuvers.

Another factor inhibiting the use of counter-opponent strategy in prior word games has been the awkwardness of competitors having to switch positions at a game board to analyze a portion of the board on which an opponent is playing. While devices permitting rotation of a game board have been used in the field of games such as that shown in U.S. Pat. No. 3,030,122 (Scharp), such devices have tended to be large and bulky and could not readily be accommodated by conventional, compact game packaging in which the game board is folded to one-half or one-quarter of its full size for storage in a game box. A small device capable of providing rotation and support for a relatively large folding game board, and which could be stored in a compact game box could prove of substantial benefit in board games.

The folding game board which is commonly used in the art to permit a compact packaging system has also been a frequent source of frustration to game players. The instability of folding game boards when they are not resting on a large, flat supporting surface makes it virtually impossible to use such a board on a small or non-uniform surface or to move it from one location to another during play without disturbing the playing pieces. For example, a player might wish to keep such a board on his lap while riding in a bus or train.

Objects of the Invention

It is therefore a broad object of this invention to provide a game of skill for one or more players involving word building and scoring in a format which permits fast paced strategic gameplay.

It is another object to increase educational value and enjoyment of a word game by promoting the formation of a greater number of long, multisyllable words.

It is a further object to provide a more convenient apparatus and packaging system for a board game, especially one which uses a rotating gameboard.

SUMMARY

In accordance with a presently preferred, but nonetheless illustrative embodiment of the invention, the foregoing objects, and other objects, features and advantages, which will become apparent as the description proceeds, are achieved by providing an apparatus and method for building words in interconnecting patterns in word-building structures disposed on the surface of a rotatable folding game board.

In the preferred method and apparatus, a word-building structure having a plurality of playing spaces is associated with each competitor, as well as a color-coded set of playing pieces containing alphanumeric characters. The preferred word-building structure comprises a pyramid-shaped grid having forty-nine playing spaces. The pyramid is arranged in seven rows, with thirteen playing spaces in the base row and two less playing spaces in each succeedingly higher row.

Each competitor uses his color-coded set of playing pieces for building intersecting words in the horizontal, vertical, and diagonal directions in his respective word-building structure during a three minute word-building phase. The game board is then rotated to place each competitor in front of an opponent's word-building structure for an offensive phase, during which a competitor may strategically place his playing pieces to block selected spaces adjacent previously built words on an opponent's structure, thereby limiting the opponent's use of the blocked spaces in subsequent word-building phases and capturing the scoring value of the blocked words. Play continues with alternating word-building phases and offensive phases until one of a set of predetermined conditions occurs. Scores are tallied at the end of a game, at which time the point values of words are determined and the final determination of their ownership is made. Point values are determined according to the length and the ownership of a word and the sum of the point values of its letters, as indicated on the face of the playing pieces.

The preferred game structure also includes a rotation mechanism having a base and rotating upper platform which is substantially smaller than the surface area of the game board. The game board is locked in its unfolded position and secured to the rotation mechanism by suitable connection means such as a threaded bolt and knob in conjunction with a locking member such as a flat plate or other device for applying surface pressure to a plurality of gameboard sections.

The preferred packaging system comprises a game box in which word trays and individually packaged sets of playing pieces are placed on a pre-formed, removable insert, on top of the rotating upper platform. These gameplaying accessories may thus be removed from the box in one operation by lifting the above-mentioned knob which is attached to the upper platform, thereby withdrawing the rotation mechanism, the individually packaged playing pieces, and the word trays.

In an alternate embodiment of the inventive method and apparatus, a solitaire word game is provided in which one word-building structure and one set of playing pieces are used in achieving the highest possible score by building intersecting words in the horizontal, vertical and diagonal directions.

BRIEF DESCRIPTION OF THE DRAWINGS

In describing the preferred embodiment of the present invention, reference will be made to the appended drawings in which.

DETAILED DESCRIPTION

Figure 1:
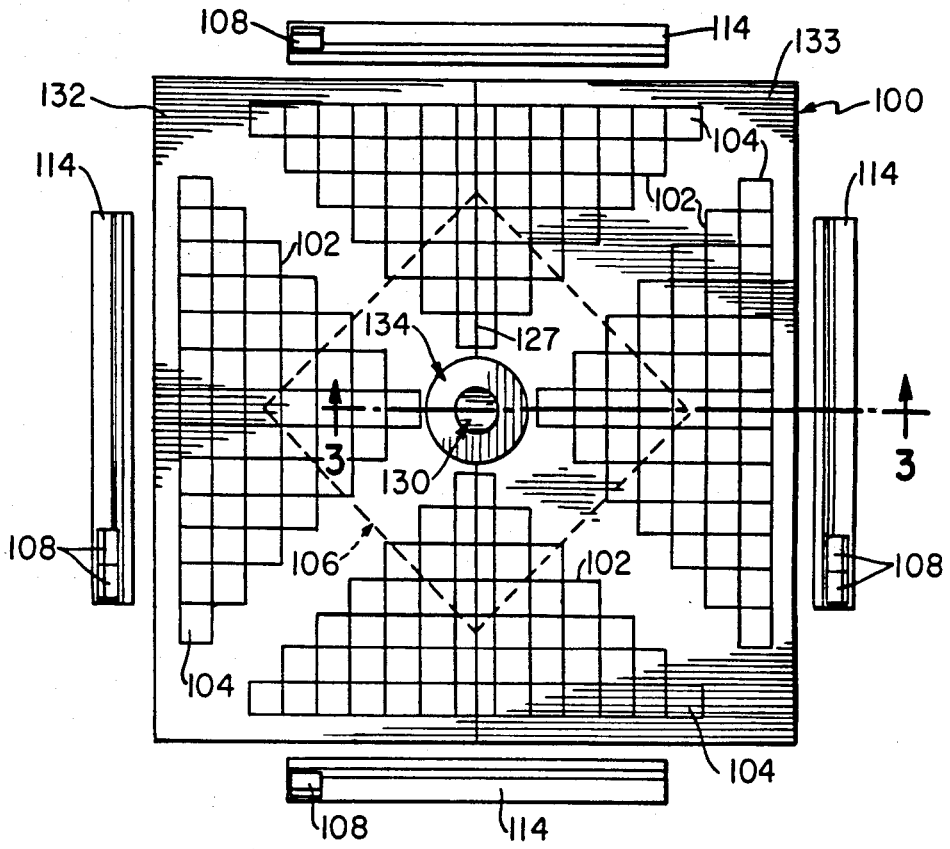
FIG. 1 is a plan view of a game board illustrating preferred word-building structures with a connecting and locking device in the center of the board. The upper platform of a rotation mechanism is shown in phantom view.

FIG. 1 shows a game board 100 particularly adapted to playing a word game according to the present invention. A plurality of word-building structures 102 are disposed around the board 100, said structures preferably being pyramid-shaped with their bases at one of the edges of the gameboard's perimeter and their peaks extending toward the center of the gameboard. Each pyramid-shaped structure 102 contains rows of playing spaces 104, preferably with thirteen playing spaces in the lowest or base row and each successively higher row having two less playing spaces. This creates a pyramidal structure with seven rows of squares, the base row having thirteen and the top row having one square, resulting in a total of 49 playing spaces per structure.

An alternate embodiment of this invention may include variations on the size and shape of the word-building structure 102; however, the preferred arrangement offers an excellent format for interconnected words of varying length and complexity which may be read in four directions: horizontally across, diagonally up or down (from left to right) and vertically from top to bottom. While the invention may be practised with word building permitted in any number of directions, the above format will be assumed for the description herein.

Another advantage of the pyramidal shape may be seen in FIG. 1, where the structures 102 are pictured on a typical four-sided game board. This shape allows four such structures to be placed as shown with a minimum of wasted space, thus creating a compact playing surface. The illustrated placement of the building structures also allows sufficient space in the center of the gameboard 100 for attachment of the board to a rotation mechanism 106, as described hereinafter.

Figure 2A:
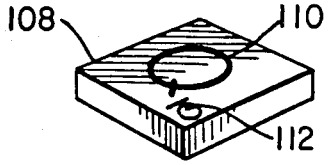
FIG. 2*a* is a perspective view of a playing piece for use with the game board of FIG. 1.
Figure 2B:
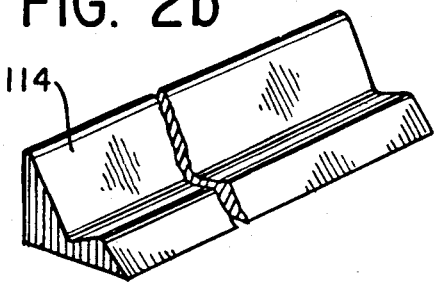
FIG. 2*b* is a perspective view of a word tray for holding a group of playing pieces.
Figure 2C:
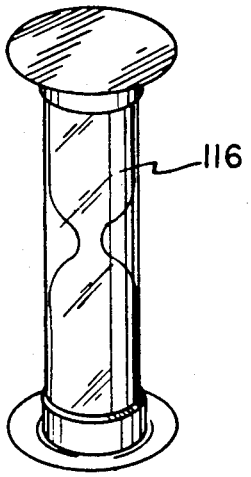
FIG. 2*c* is a perspective view of a device for timing gameplay.

As illustrated in FIG. 2, alphanumeric character representing elements, such as playing pieces 108, are provided to each competitor for use during gameplay. Playing pieces 108 may be either marked or blank, and are designed to fit within a playing space 104 on a word-building structure 102, as described above. Marked playing pieces 108 each contain an alphanumeric character 110 and preferably include a scoring character 112. A set of alphanumeric characters 110 includes every alphabetic letter of the language in which the game is to be played. It may also include the numerals or other symbols of that language to increase the variety of words or phrases that could be used in the word building process. In the preferred embodiment, the playing pieces 108 are grouped in distinguishable sets, each including the letters A through Z and containing four each of the vowels A, E, I and O, three of the vowel U, two each of the consonants B, C, D, L, M, N, R, S and T, and one of each of the other consonants in the alphabet. This grouping provides a total of 49 marked playing pieces corresponding to the 49 spaces on each word-building structure. Three additional blank playing pieces 108 may be incorporated in each set for reasons which will be explained later. This brings the total number of playing pieces 108 in each set to 52.

A different set of playing pieces 108 is provided for each competitor, and each set of pieces is preferably distinguished from the others by color, shape, design or any other device for making playing pieces distinguishable. In the preferred embodiment of the invention, distinguishability is provided by color coding the playing pieces 108 so that the pieces in each set have the same distinguishing color. The quantity of playing pieces 108 and distribution of alphanumeric characters 110 within a distinguishable set of playing pieces may vary substantially from the above format without departing from the scope and spirit of the invention. However, one purpose for the aforementioned format of 49 letters and 49 squares is to provide the challenge of filling all the spaces of a pyramid in a game of solitaire. This format further permits a player in a competitive game to be awarded bonus points for using all of his allocated playing pieces.

Since the preferred distribution of alphanumeric characters 110 contains only alphabetic letters, the method of play to be described will discuss the use of playing pieces 108 in terms of an arrangement of letters. It is to be understood that the methods discussed would similarly apply to a distribution of alphanumeric characters 110 which included numerals or other non-alphabetic symbols.

Word trays 114 may be provided for each competitor to aid in constructing words from the playing pieces 108 before transferring them to the competitor's word-building structure 102. These trays 114 should be of sufficient length to hold at least twelve playing pieces 108. A timing device, such as a three-minute timer 116, may also be provided for use in accordance with the proposed rules of play.

The preferred embodiment of the invention incorporates a rotation mechanism 106 for allowing rotation of the game board 100 in conjunction with various phases of gameplay. As will be described later, the inventive method of gameplay includes an offensive phase during which a competitor places his playing pieces onto his opponent's word-building structure 102. The rotation mechanism 106 allows the board 100 to be rotated so that each word-building structure 102 may be read more easily by the competitors.

Figure 3:
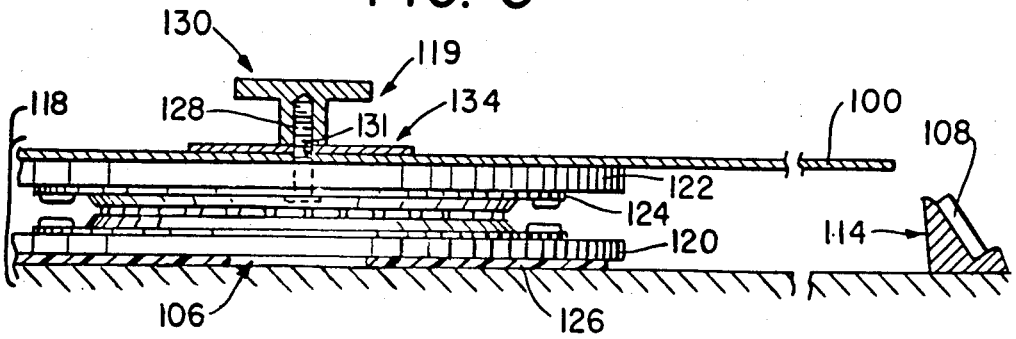
FIG. 3 is a side elevational view of a rotation mechanism with gameboard mounted thereon taken along line 3—3 of FIG. 1.

FIG. 3 is an elevational view illustrating one embodiment of such a rotation mechanism 106, having a platform portion 118 and board stabilizing elements 119.

Platform portion 118 rests on a table top or other supporting surface, and permits gameboard 100 to be rotated relative to that surface. The preferred platform portion 118 comprises a stationary base 120 and an upper platform 122 which supports folding gameboard 100 and rotates relative to stationary base 120. A ball-bearing partition 124, or other low-friction device, is mounted between base 120 and upper platform 122 to facilitate rotation. Base 120 may be provided with rubber feet 126 or the like, to prevent slipping or marring on a table top or other supporting surface. Felt pads (not shown) may also be placed between base 120 and upper platform 122, to provide a limited amount of friction therebetween for preventing unintentional rotation of gameboard 100.

Board stabilizing elements 119 are used to secure folding game board 100 to platform portion 118, in order to stabilize the board and thus prevent playing pieces 108 from shifting. These stabilizing elements 119 preferably provide at least two degrees of support for folding gameboard 100.

The first degree of support is provided by connecting gameboard 100 to platform portion 118 at or near flexible seam 127, via connection members such as bolt 128 mounted in upper platform 122, and cooperatively threaded knob 130. These members provide interlocking cooperation through aperture 131 in the center of gameboard 100, and prevent the gameboard from buckling at seam 127 (i.e. in an inverted V-shape) in response to gravity or other downward pressure acting on an area of the board which is not resting on upper platform 122, such as the board's periphery. Knob 130 is preferably shaped to permit a player to lift gameboard 100 by the knob, thus facilitating relocation of the board and playing pieces 108 thereon.

A second degree of support is provided by distributing the downward pressure of knob 130 over sections 132 and 133 of gameboard 100, to lock the board in a flat or unfolded position, as by plate 134 acting between knob 130 and gameboard 100. The cooperation of knob 130 and plate 134 prevents sections 132 and 133 of gameboard 100 from buckling in a V-shaped when upward pressure is applied to the underside of the gameboard, e.g. when it is lifted at or near its periphery for relocation to another table or supporting surface. While knob 130 is preferably used for lifting the gameboard 100, it may also be desirable to lift the board by its edges, or to stabilize the board by grasping an edge with one hand while lifting on the knob. Plate 134 should therefore be large and strong enough to keep gameboard 100 locked flat when it is lifted at its periphery, while not obstructing any printed matter which may be near the center of the gameboard. Plate 134 is preferably filigreed for decorative effect.

The preferred embodiment of the rotation mechanism 106 is further designed to raise the gameboard 100 above the level of the tabletop. This allows the game board to be rotated without knocking over the game trays 114 which are normally placed on a table surface near the perimeter of the gameboard.

The use of connection and locking members, such as bolt 128, knob 130 and plate 134, to secure gameboard 100, permits the use of a platform portion 118 which is smaller than the gameboard 100, while maintaining adequate stability for game play. The rotation mechanism 106 may therefore be proportioned to fit into a box which is no larger than the folded game board. In the preferred embodiment illustrated in FIGS. 1 (phantom view) and 3, the platform portion 118 is square, with a surface area one-fourth the size of the gameboard 100 to permit packaging with either a half or quarter-folded board.

It will be appreciated that bolt 128, knob 130 and plate 134, or similar connection and locking members, may also be used with a stationary platform to provide a locking device for a folding gameboard 100 without incorporating the feature of low friction rotation of the gameboard. Since rotation is not necessary with many board games, a stationary platform could provide the above-described advantages of clamping a folding gameboard 100 in a rigid position while eliminating the cost factor of supplying such a device with a low friction rotating means such as ballbearing platform 124. A stationary platform may be used, for example, to stiffen a folding gameboard resting on the laps of two game players seated next to each other while traveling. When used in this manner, it will be noted that the platform portion 118 of the invention need not rest on a supporting surface, as the necessity of providing rotation relative to such a surface is no longer needed.

Figure 4:
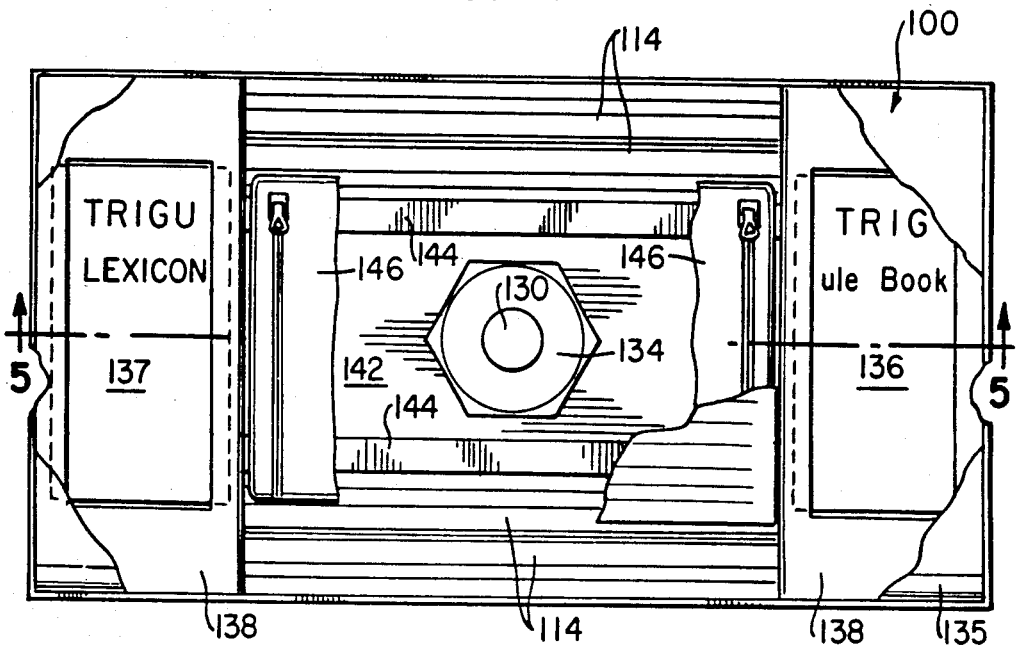
FIG. 4 is a plan view of a storage box broken away to show the placement of the rotation mechanism of FIG. 3, playing accessories of FIG. 2, and folded gameboard of FIG. 1 in a preferred arrangement.
Figure 5:
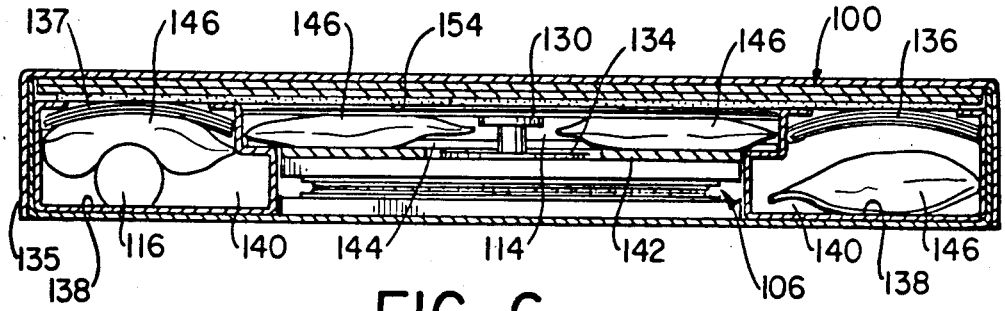
FIG. 5 is an elevational cross-section of the box of FIG. 4, taken along line 5—5.

FIG. 4 shows a plan view of a preferred packaging arrangement for the proposed game, illustrating the placement in box 135 of gameboard 100 rotation mechanism 106, the game playing accessories of FIG. 2, a rule book 136, and an optional lexicon 137 of words which may be formed in a given number of playing spaces 104. Cardboard inserts 138 are used to hold the rotation mechanism 106 and gameplaying accessories in place during storage. The timer 116 may be placed in one of the open compartments 140 in inserts 138, underneath either rulebook 136 or lexicon 137. A removable insert 142 formed with ridges 144 may be used to hold the word trays 114 securely in place. The four colored sets of playing pieces 108 may be kept in four separate resealable packets 146, two of which may be placed on the removable insert 142 between the word trays 114 as shown. The other two packets 146 may be stored in the open compartments 140 at each end of the box 135 and beneath the rule book 136 and lexicon 137.

A distinct advantage of the above-described packaging system is the ability to remove the rotation mechanism 106, word trays 114, and two sets of playing pieces 108 from the box 135 in one step, by lifting the knob 130 attached to bolt 128 protruding from the center of the upper platform 122. Attaching the plate 134 and knob 130 to the bolt 128 after having used the game, and before storing it, facilitates this convenience.

When the game is completely stored in the box 135 the folded gameboard 100 may rest atop all other parts with a protective sheet of light-weight polyethylene 154 or some other non-scratch material therebetween.

Method of Play

A preferred method of play through manipulation of the various components is described below.

Each of the competitors selects a word building structure 102, a word tray 114 and a set of playing pieces 108. The competitors arrange their playing pieces 108 face down on a table-top or other surface (not shown), and prepare to start play. When all competitors are ready each draws up to 12 of his colored playing pieces 108 from the table at random and places them face up on his word tray 114. The timer 116 is then started and all competitors simultaneously proceed to build words or parts of words within their respective structures 102. This period of gameplay will be referred to as the first word building phase. The first word-building phase continues until a predetermined condition occurs, such as the passage of a specified time period. In the preferred embodiment described below, the predetermined condition which ends the first (and any subsequent) word-building phase is a lapse of three minutes from the start of the word-building phase.

During the first (and any subsequent) word-building phase a competitor may build or form words in the horizontal, diagonally upward, or diagonally downward directions, with the words reading from left to right, or in the vertical direction with the words reading from top to bottom. Ordinarily, words cannot be created reading in directions which are the reverse of those stated above, with the exception that a single word may be scored twice if it forms a word in both the forward and reverse directions. During the word-building phases, competitors are not restricted to creating completed words on their word-building structures. For example, if a competitor has all but one of the letters comprising a 7-letter word, he may place his 6 letters in position on his word-building structure 102 leaving a blank playing space 104 for the missing letter which may be filled in during a subsequent word-building phase.

During a word-building phase, if a competitor has drawn any of the blank playing pieces 108 (hereafter called "guards"), he may insert them in strategic places on his word-building structure 102 in order to protect the words or parts of words he has just formed. For example, the placement of a guard after a competitor's completed word prevents his opponent from expanding on that word during a subsequent offensive phase, and capturing its value as discussed below. Similarly, the placement of a guard after a partially finished word prevents the opponent from placing one of his letters in the guarded space to form a complete word and capture its value. A competitor may move his guards around his word-building structure 102 during a word-building phase, or remove them from the board for later use. If a competitor has drawn all three of his guards, he may use one of them as a "joker" on his opponent's word-building structure 102 as described below.

After the first three-minute word-building phase has elapsed, word building is stopped and a brief period may be provided to allow all competitors to arrange their final placement of the guards. All competitors then proceed to the first of a number of offensive phases. Each competitor changes his position at the board and sits in front of the word-building structure 102 of another competitor, to perform offensive operations thereon as the other competitor's designated opponent. In the preferred embodiment this is facilitated by rotating the board 100 using the rotation mechanism 106 to place the respective word-building structures 102 in front of the appropriate competitors for the offensive phase.

For the purpose of the following description, various aspects of the preferred method of gameplay will be described with respect to two competitors who are mutual opponents, and their word-building or offensive operations on the word-building structures before them during a given phase of gameplay. As defined in the specification, a given competitor's "opponent" is the one who performs offensive operations on the given competitor's word-building structure during an offensive phase. It is to be understood that all competitors will be simultaneously performing similar operations on the respective word-building structures 102 before them during each word-building and offensive phase. That is, each "competitor" performs word-building operations in his own word-building structure during word-building phases, and acts as an "opponent" of another competitor (on that competitor's word-building structure) during offensive phases. Also, in the preferred embodiment, the relationship of a given competitor and his opponent is mutual; that is, both perform offensive operations on each other's word-building structures during an offensive phase.

During one offensive phase a competitor is permitted to place the playing pieces 108 remaining on his word tray 114 in strategic playing spaces 104 on his opponent's word-building structure 102 to "modify" words (or parts of words) previously built on that word-building structure, thereby "capturing" the scoring value of the original word and "blocking" the playing spaces 104 occupied by the modifying letters. As defined in this specification, a word is "modified" when a competitor places a modifying piece, comprising one of his playing pieces 108 (recognizeable as his by virtue of its color), at the end of a word (or part of a word) which was placed by his opponent on the opponent's word-building structure during a preceeding word-building phase, thereby forming a modified word whose scoring value, for the time being, has been captured and belongs to the competitor who placed the modifying piece.

Figure 6:
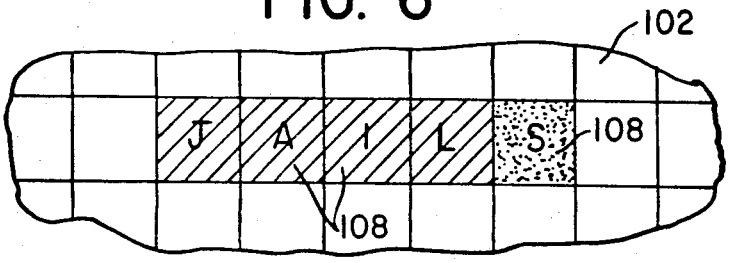
FIG. 6 illustrates a portion of a word-building structure on which a word has been built by a competitor and modified by his opponent.

Preferably, a competitor may not use more than one playing piece 108 to create a particular modified word during any one offensive phase. For example, FIG. 6 illustrates a portion of a competitor's word-building structure in which the word JAIL was originally formed by the competitor (whose color is represented by cross-hatching) and was subsequently modified by his opponent by adding the letter "S" (dotted playing piece). If the game were to end at this point, the opponent would receive credit for the word JAILS, and the competitor would not receive credit for either JAIL or JAILS. Thus if the opponent modifies a word which was formed by the competitor, and the modified word is not subsequently rebuilt (see below), the modified word is scored in favor of the opponent, and the competitor does not receive any score for that word (or for the original word which was modified). Additionally, the opponent's modifying piece, which is distinguished from the competitor's playing pieces by its color, serves a blocking function in subsequent word-building and offensive phases, as the competitor may not use the opponent's modifying letter except for the purpose of further expanding the modified word and recapturing its value, as described below.

In the preferred embodiment, "modifying a word" does not consist exclusively of placing a piece 108 after an opponent's completed word on the opponent's word-building structure. The playing piece 108 may be placed anywhere within the opponent's structure 102 as long as the modifying letter used completes a word in any one of the four directions mentioned previously, and follows a playing piece belonging to the opponent. This procedure may complete a word originally started by the opponent, may interrupt the forming of a word by the opponent which has blank spaces, or may create a word by branching off in any of the four allowed directions from any one of the opponent's playing pieces. However, if a competitor places a modifying letter after a complete word on his opponent's word-building structure, the modifying letter may not be used to separate a portion of the complete word. For example, if the word HI is on a competitor's word-building structure, his opponent may not place his (the opponent's) letter F after the word HI with the intention of forming the word IF. Instead, he must use another letter, such as T, which expands the complete word HI to form the modified word HIT.

As discussed above, a competitor may form part of a word on his word-building structure 102 during a word-building phase, and then fill in the missing letters in a subsequent word-building phase after drawing a new set of letters. For example, if the competitor is left with the letters M, O, T and R on his word tray 114 as the end of a word-building phase approaches, he may want to place the letters MOT R on his word-building structure, expecting to complete the word MOTOR after he draws another letter "O" in a future word-building phase. However, this plan may be undermined if the competitor's opponent places the letter "E" after MOT during an offensive phase before the competitor has been able to complete the word, thus creating the modified word MOTE. The opponent would then have captured the scoring value of the word MOTE on the competitor's word-building structure, and left the competitor with the problem of forming a word with the remaining letter "R" or having that letter count against him in the scoring phase of the game (described below).

During the offensive phase a competitor may use as modifying pieces any of the playing pieces 108 remaining on his word tray 114 after the preceeding word-building phase. However, if he has used all 12 of his playing pieces 102 during the preceeding word-building phase, he receives a scoring bonus and is further permitted to draw one of his face-down playing pieces for use as a modifying piece. If he is able to use that playing piece for modifying, he may continue drawing one playing piece at a time, using it for modifying until he either is unable or unwilling to modify any further. Competitors are thereby given incentive to use all their playing pieces 108 during the word-building phases (even though they may not form completed words), resulting in more active gameplay.

Another feature of the offensive phase involves the use of the aforementioned blank playing pieces 108 or "guards" as modifying pieces which may assume the role of any alphanumeric character. If a competitor has drawn all three of his guards, any one of the guards may then be redesignated as a "joker" and used for modifying a word on his opponent's word-building structure 102. If the competitor has placed all three of his guards on his word-building structure 102 and subsequently decides to use one of them as a joker, he may remove a guard from his word-building structure 102 and place it on his word tray 114 for re-designation as a joker during the upcoming offensive phase. This guard must be on the competitor's word tray 114 before the board 100 is rotated and the offensive phase begins.

If a competitor has a guard on his word tray 114 during an offensive phase, he may decide during that phase whether or not to redesignate the guard as a joker (assuming all three guards have been drawn). If used as a joker for modifying a word, it is announced by the competitor what letter it is being used as. It then remains that same letter throughout the game. It is also counted in the scoring as its acquired identity and assumes the corresponding value. If the competitor decides not to redesignate his guard as a joker during that offensive phase, it may be placed on his word-building structure 102 as a guard during the following word-building phase, regardless of whether it was previously used as a guard and removed for possible use as a joker. Alternatively, the guard may be set aside on the competitor's word tray to be used later as either a guard or joker. Competitors are allowed extra time at the end of each three-minute word-building phase to manipulate their guards and to decide which of the three (if all three have been drawn) would best be used as a joker. As a variation of the preferred embodiment, the third guard may instead be used as a joker on a competitor's own structure for word-building.

The offensive phase continues until a predetermined condition occurs, such as all competitors declaring that they have completed their respective modifications on the word building structures presently before them. The offensive phase is preferably not timed, however the competitors may choose to apply a time limit in order to increase the pace of the game.

When the first offensive phase is completed, the competitors resume their former positions at their respective word-building structures 102 and a second word-building phase begins. Each competitor draws as many of his face down playing pieces 108 as are necessary to replace the playing pieces used on his word tray 114, up to a total of twelve. The three-minute timer 116 is started again and all competitors recommence the word building procedure, with the added limitation that an opponent's modifying letter may not be used to form a new word in a direction which intersects the word modified by that letter. The competitors may, however, attempt to rebuild those words which were modified by their opponents, thus recapturing their value.

During the second and any subsequent word-building phase, a competitor may "rebuild" a modified word on his own word-building structure by adding one or more letters to the modified word to form a complete word which changes the modified word's form or meaning and recaptures its value from his opponent. For example, consider the case in which a competitor's opponent has placed his letter "T" after the competitor's word HI on the competitor's word-building structure to form the modified word HIT. If there are blank spaces following the word HIT, the competitor may be able to rebuild the word with an "S" for HITS, or with "TING" for HITTING. If a word is rebuilt by a competitor, he may use his added letter or letters for building other words in other directions. However he may never use his opponent's modifying letter for building in a direction other than that of the modified word; thus the modifying letter's blocking function is maintained even though the modified word's value has been recaptured.

At the end of the second word building phase another offensive phase begins and opponents are given another chance to modify words (or parts of words) on each other's word building structures 102 as previously described. They may also remodify words which were previously rebuilt by their respective opponents.

A competitor and his opponent may continue, respectively, to rebuild and remodify the same word on the competitor's word-building structure several times, limited only by the number of word-building phases in the game and the number of unused playing spaces 104 which follow the word. Ultimately, the word's value, for the purpose of scoring, belongs to the one who has placed the final letter of that word on the board. However, the first modifying letter and any subsequent remodifying letters retain their blocking character throughout the game regardless of the eventual scoring status of the word's value.

Play continues between alternate word-building phases and offensive phases until one of a set of predetermined conditions occurs. In the preferred embodiment, this set of predetermined conditions comprises the following three events: (1) one of the competitors using the last of his 49 marked playing pieces, (2) one of the competitors calling for the start of a "FINAL" phase, or (3) all of the competitors declaring that they have no further moves.

If play progresses to the point where one of the competitors has used all of his 49 marked playing pieces 108, then either: (a) if a word-building phase is in progress, the other competitors may continue to build words until the three minute time period of that word-building phase has ended, at which point all competition stops; or (b) if an offensive phase is in progress, competition immediately stops.

Competition may also be concluded by the use of a "FINAL" phase, as mentioned above. If any competitor has four or fewer playing pieces 108 remaining from his original set of 49 marked pieces, he may call the word "FINAL" in order to initiate the final phase. A competitor may only call FINAL after an offensive phase has ended and before the following word-building phase begins. When a competitor has called FINAL, that competitor may not make any further moves, and the other competitors may fill their word trays 114 and begin a final three-minute word-building phase, after which the competition ends.

The competition may also end when all competitors declare they have no further moves, in which case the competition immediately stops.

While this game may accommodate any number of competitors, the preferred embodiment would allow for play as described above between two, three or four competitors, each of which has only one designated opponent for offensive purposes. While the foregoing description discusses gameplay between two competitors who are mutual opponents, it is to be understood that an alternate embodiment may provide otherwise. For example, a game may be played according to the invention in which competitor A's opponent (i.e. the competitor who performs offensive operations on A's word-building structure during offensive phases) is competitor B, competitor's B opponent is competitor C, C's opponent is D, and D's opponent is A. Other embodiments may include offensive schemes involving more than one opponent for additional complexity. A solitaire version of this game may be played by eliminating the modifying procedure and attempting to achieve the highest score possible within the confines of the word-building structure 102 set forth above.

Another embodiment of the invention includes the use of playing teams. In one such embodiment two teams of two partners each may be formed, with the partners sitting opposite each other at the playing board. Offensive play may take place by rotating the board 90° in a clockwise direction for the first offensive phase and 90° in the counterclockwise direction for the second offensive phase, alternating each successive offensive phase.

In another embodiment involving team play each competitor may draw from his partner's undrawn playing pieces 108, if desired, in order to acquire some or all of his twelve playing pieces for use during a following word-building phase. This may be advantageous for example, when a competitor has used all of his playing pieces which contain a desired letter and he knows that his partner has not yet drawn all such playing pieces from the partner's respective set. Also, it could be advantageous if one has used up most of his playing pieces 108 but his partner still has many left on the table. Helping to use up a partner's playing pieces may allow for a higher score, and possibly finish the game or result in a bonus award. The same rules would apply in ending the game as with single competitors. However, in order to end the game by calling "FINAL", partners must be left with only four playing pieces 108 between them.

In the preferred embodiment scoring is not done until the end of the game, when each competitor counts his own score. The suggested method for adding scores is to first tally all the values of the scorable words that were either built or rebuilt on one's own word-building structure 102, and then to rotate the board 100, when everyone is ready, to tally the scorable modified and remodified words on the word building structure of one's opponent. In the first tally, a competitor may score any word on his own word-building structure 102 which ends with his letter and has not been further expanded upon (e.g. through modification). In the second tally, a competitor may further score any word on his opponent's structure which ends with his modifying letter and has not been further expanded upon (i.e., through rebuilding by his opponent).

While a competitor may have originally modified a word in only one direction, further words may have inadvertently been formed by his opponent in other directions which end on the modifying letter, and these words are all scored for the competitor. It will be seen that the different color of modifying letters will facilitate spotting all the words created by those letters. In the preferred embodiment, the scoring value of a scorable modified or remodified word (i.e., a word which ends in a modifying letter and has not been further expanded upon) is twice the value of an equivalent word which has not been modified or remodified. However a scorable rebuilt word (i.e. one which is built by a competitor, modified by his opponent, then rebuilt by the competitor and not further expanded upon) is preferably not awarded any additional scoring value than the same word would have had if it were originally built by that competitor.

As used in this specification, the term "scorable" refers to any word on the gameboard which is used in determining any competitor's score. From the above description it will be understood that not all words on a given word-building structure are scorable. For example, a word that contains a blocking letter (i.e., an opponent's letter that was used to modify an intersecting word) is not scorable unless the word ends on the blocking letter (in which case it is scorable for the opponent). Also, a word that has been further expanded upon (e.g. through modification or rebuilding) is not separately scorable, apart from the final version of the word.

The preferred point value for individual letters is as follows: A, E, I, O, U and L receive 1 point each; D, G, N, R, S and T receive 2 points each; B, C, F, H, M, P, V, W and Y receive 4 points each; J, K and X receive 6 points each; and Q and Z receive 10 points each. The stated values are preferably included as scoring characters 112 on the playing pieces 108, to facilitate rapid scoring. It should be understood that these point values can vary while still retaining all other competitive aspects of the game. For example, one embodiment may provide for "Wild Card" letters which the competitors may predetermine to have a certain value.

Since the game board 100 preferably does not include any score markings or instructions on the playing spaces 104, as in some other word games, scoring may be accomplished without having to remove the playing pieces 108.

In the preferred embodiment of the invention, word-building and modifying in the various word-building structures 102 is accomplished without regard to the content of adjacent words. That is, two words may be built in series (i.e. one after the other) in the same line, without having to leave a blank playing space between the two words to indicate where the first word ends and the second word begins. Also, a word may be arranged alongside and parallel to another word (i.e., side by side) without having to create additional words from adjacent letters in the parallel words, as in popular cross-word puzzles. This enhances a competitor's ability to create words and to use all his spaces 104 and all his playing pieces 108. However, it should also be understood that an experienced competitor will attempt to create as many cross-building words as possible, in order to increase his score.

In the preferred embodiment a competitor's score is determined according to the composition of words which are scorable to that competitor; i.e., those words he has built on his word-building structure and retained, those words which he has modified or remodified on his opponent's structure which were not subsequently rebuilt, and the rebuilt words on his structure which were not subsequently remodified. Each word has a base scoring value which is computed by summing the point values of each letter in the word. A word's base score may then be increased according to the length of the word, to determine the word's "modified base score." This encourages the formation of longer words than a scoring system which places equal weight on words of any length, and thereby encourages competitors to improve their vocabulary. Words of 2 to 4 letters are preferably scored at their base value, words of 5 or 6 letters have double base value, and words of 7 or more letters have triple base value. In an alternate embodiment, words of 11 to 13 letters may win a bonus of fixed point value, e.g. 100 points, in addition to their triple base value. As stated earlier, words which can be read in the forward and reverse directions may be scored in both directions, effectively doubling the scoring value of such words. Also, modified or remodified words which have not been further expanded upon receive double their normal value, as previously discussed. Thus, a word's scoring value is preferably determined by multiplying the word's base scoring value by an integer multiplying factor based on the word's length, its ability to be read in either direction, and the word's scoring status (i.e., whether built, modified, rebuilt or remodified) at the end of a game.

A competitor is preferably penalized (10 points) for each letter left on his word-building structure 102 at the end of the game which does not form a word. Ten points are also deducted from a competitor's score for each of his undrawn playing pieces 108 (i.e. those left face down on the table) and the playing pieces left on his word tray 114 at the end of the game. In a variation of the preferred scoring system, undrawn playing pieces may be deducted only to the extent of their individual letter values, rather than deducting 10 points for each piece regardless of its value.

In another variation of the preferred embodiment, competitors may add the totals of a series of three games in order to decide which one is the winner.

In accordance with a further aspect of the invention, scoring bonuses are provided for various accomplishments during the play of the game. In the preferred embodiment a competitor is awarded 50 bonus points for completing the game by using all 49 of his marked playing pieces 108. In addition, a competitor may be awarded 50 points if he utilizes all 12 playing pieces present on his word tray 114 during a particular word-building phase.

Another bonus may be provided when a competitor successfully challenges his opponent's selection of a word. Such a challenge may be made on the basis of incorrect spelling, nonexistence of such a word in an appropriate dictionary, or other similar bases for objection. In the preferred embodiment, a competitor who successfully challenges will win an additional 50 points, while his opponent deducts 50 points. If a challenger proves to be incorrect, the challenger loses 50 points. Challenging may be done only during the offensive phase or at the end of the game.

The scoring of a game will now be described with reference to the following table and to FIG. 7, which illustrates the respective word-building structures of two competitors after completion of a game. For purposes of the following example, the dictionary used to determine if a given word qualifies for game use was Webster's New World Dictionary, College Edition, Copyright 1964 and 1953, 1954, 1955, 1956, 1957, 1958, 1959, 1960, 1962 by the World Publishing Company (Library of Congress Catalog Card No.: 64-12965). Excluded from use as qualifying words were: proper nouns, abbreviations, single letters (e.g. A), possessive forms (e.g. men's), contractions (e.g. don't), hyphenated words, prefixes and suffixes.

In the following table, the "Base Score" column shows the sum of the point values for the letters of each of the words on the gameboard, and the "Multiplying Factor" indicates the number by which the Base Score is to be multiplied in order to arrive at a given word's scoring value as discussed above. The "Scoring Value" column indicates either the base scoring value of a given word or, if applicable, the Base Score times the given word's Multiplying Factor. "Comments" A to J, following the table, indicate how the Scoring Values were determined. The table also shows how "Bonus Scoring" and "Unused Letters" are included in the final tally. Note that the Bonus Scores pertaining to "Challenges" and "Use of All 12 Pieces In Word-Building Phases" are by way of example only, since the value of these scores cannot be determined from the board arrangement in FIG. 7. The "Final Total" for each competitor is determined by summing the "1st Subtotal" (the total of the Scoring Values for that competitor's built words and modified words) and the "2nd Subtotal" (the total of that competitor's Bonus Scoring and Unused Letter scoring).

Figure 7A:
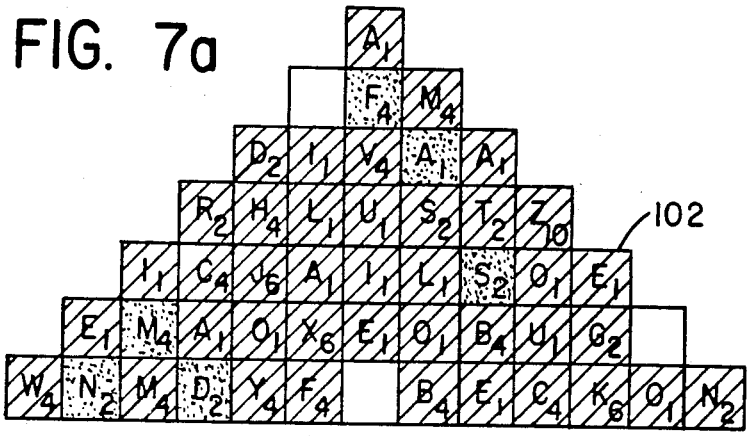
FIG. 7*a* illustrates the word-building structure of one competitor after he has finished active game play.

Competitor #1 (FIG. 7a)

| Words | Base Score | Multiplying Factor | Scoring Value | Comments |
|---|---|---|---|---|
| Across: | | | | |
| BECKON | 18 | 2× | 36 | A |
| OX | 7 | | 7 | |
| BUG | 7 | | 7 | |
| LUST | 6 | | 6 | |
| Down: | | | | |
| JOY | 11 | | 11 | |
| LAX | 8 | | 8 | |
| SLOB | 8 | | 8 | |
| AT | 3 | | 3 | |
| BE | 5 | | 5 | |
| Diagonal Up: | | | | |
| WEIRD | 10 | 2× | 20 | A |
| HI | N.S | | 0 | B |
| MA | 5 | 2× | 10 | C |
| IS | 3 | | 3 | |
| FELT | 8 | | 8 | |
| BO | 5 | | 5 | |
| Diagonal Down: | | | | |
| EM | 5 | 2× | 10 | C |
| AY | 5 | | 5 | |
| OF | 5 | | 5 | |
| HA | 5 | 2× | 10 | C |
| LI | 2 | | 2 | |
| TOG | 5 | 2× | 10 | C,D |
| AMAZE | 17 | 2× | 34 | A |
| Modified Words (FIG. 7b) | | | | |
| USED | 6 | 2× | 12 | E |
| AKIN | 10 | 2× | 20 | F |
| OR | 3 | 2× | 6 | F |
| BRAD | 9 | 2× | 18 | F |
| | | 1st Subtotal: | 269 | |

| Bonus Scoring | Points |
|---|---|
| Words exceeding 10 letters: None | 0 |
| Use all 49 marked pieces: No | 0 |
| Use all 12 pieces in word-building phase: 1× | +50 |
| Successful challenges: 1× (OZ) | +50 |
| Unsuccessful challenges: 1× (EX) | −50 |
| Unused Letters | |
| On board: None | 0 |
| Off board: P,Q,T,I,U (−10 pts. ea.) | −50 |
| 2nd Subtotal: | 0 |
| Final Total | 269 |

Figure 7B:
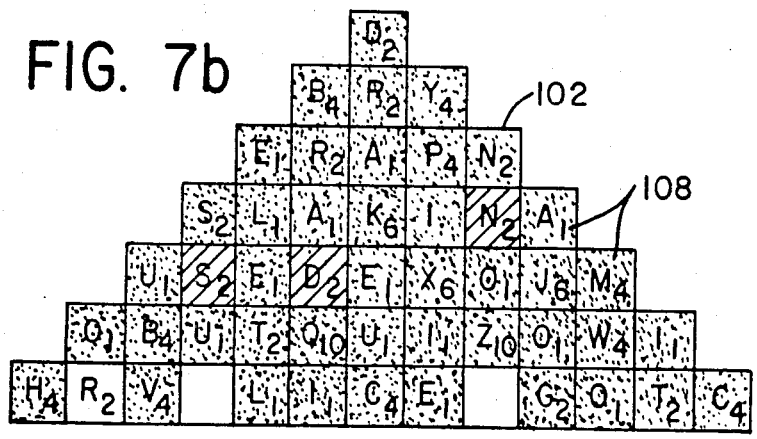
FIG. 7*b* illustrates the word-building structure of an opponent of the competitor of FIG. 7*a*, after the opponent has finished active game play.

Competitor #2 (FIG. 7b)

| Words | Base Score | Multiplying Factor | Scoring Value | Comments |
|---|---|---|---|---|
| Across: | | | | |
| LICE | 7 | | 7 | |
| GOT | 5 | 2× | 10 | C |
| BUT | 7 | 2× | 14 | C |
| QUIZ | 22 | | 22 | |
| EX | 7 | | 7 | |
| RAP | 7 | 2× | 14 | C,G |
| Down: | | | | |
| EL | 2 | | 2 | |
| ET | 3 | 2× | 6 | C |
| DRAKE | 12 | 2× | 24 | A |
| PIXIE | 13 | 2× | 26 | A |
| JOG | 9 | | 9 | |
| WO | 5 | | 5 | |
| IT | 3 | 2× | 6 | C |
| Diagonal Up: | | | | |
| HOUSE | 9 | 2× | 18 | A |
| AY | 5 | | 5 | |
| IN | 3 | | 3 | |
| Diagonal Down: | | | | |
| TI | 3 | 2× | 6 | C |
| BA | 5 | | 5 | I |
| DYNAMIC | 18 | 3× | 54 | H |
| Modified Words: (FIG. 7a) | | | | |
| EM | 5 | 4× | 20 | C,F |
| JAILS | 11 | 4× | 44 | A,F |
| DIVA | 8 | 4× | 32 | C,F |
| EN | 3 | 2× | 6 | F |
| CAD | 7 | 2× | 14 | F |
| MA | 5 | 4× | 20 | C,F |
| IF | 5 | 4× | 20 | C,F |
| OS | 3 | 4× | 12 | C,F |
| | | First Sub-total | 411 | |

| Bonus Scoring: | Points |
|---|---|
| Words exceeding 10 letters: None | 0 |
| Use all 49 marked pieces: Yes | 50 |
| Use all 12 pieces in word-building phase: 2× | 100 |
| Successful challenge: None | 0 |
| Unsuccessful challenge: 1× (OS) | −50 |
| Unused Letters | |
| On board: O (from challenged word OZ) | −10 |
| V (see comment J) | −10 |
| Off board: None | 0 |
| Second Sub-total | 80 |
| First Sub-total Brought Forward | 411 |

-continued

| Competitor #2 (FIG. 7b) | |
|---|---|
| Final Total | 491 |

COMMENTS

A: Word length 5 or 6 letters - double value.

B: Not scorable - the word HA (diagonal down) was built by Competitor #1 after the modified word IF (diagonal up) was formed by his opponent, the Competitor #2; the coincidental forming of the word HI is not scorable to Competitor #1, since the letter I is already part of a modified word created by his opponent. Note that IF could not have been formed after HI was built, since the modifying letter F would then be separating a portion of a completed word, contrary to the rules of the preferred embodiment (see discussion above regarding the modification of HI to form HIT).

C: Forms a word reading forwards and backwards - double value.

D: Alternatively the words TO and GO could be scored for a combined score of 6. However, TOG yields the higher scoring value (10), since it can be read in reverse.

E: Modified, rebuilt, and remodified - double value for Competitor #1 only. Note that the word USE would have been scored as 4 points (single value) for Competitor #2 had it not been remodified.

F: Modified word - double value.

G: Either ERA or RAP may be scored; RAP has greater point value.

H: Word length greater than 6 letters - triple value.

I: Ab is either a proper noun (the eleventh month of the Hebrew calendar) or an abbreviation (Alabamine); therefore BA is not scored twice.

J: Initially, Competitor #2 may have placed the letter V on his bottom row, intending to fill in the blank spaces on either side of the V (e.g. to form the word HAVE) during a later word-building phase after drawing the necessary letters. Howeverthe formation of the word OR by Competitor #1's use of his modifying letter R prevented Competitor #2 from using his V as he had intended. Since Competitor #2 was not able to use the V to form a word by the end of the game, that letter is counted against him.

While the description above discloses specific preferred embodiments, it is to be clearly understood that the invention is not to be limited to the exact constructions, mechanisms and methods of manipulating pieces which are illustrated and described, because various modifications of these details may be provided without departing from the scope and spirit of the invention as defined in the claims. For example, an electronic version of this game could be a television screen to display the word building structures 102, and a keyboard to enter alphanumeric characters 110 onto the screen. Another embodiment may be envisioned whereby a computer, having access to a memory bank containing a selection of accepted game words, could choose the best words and combinations thereby improving a competitor's own game. A computer could also be a convenient opponent, as in the present chess computer games, when a player is unable to find another person with whom to play.

It should also be noted that the offensive phase described herein may be practiced with many variations from the preferred method of playing, while not departing from the invention. For example, the modification of a word by an opponent need not involve the capturing of that word's value, but may be done for the sole purpose of preventing the competitor who built the word from later expanding on it, or from using the blocked playing space 104 for building other words in other directions.

Another adaptation of the invention may include an offensive phase in which the modification of a word captures the word's value without blocking the space occupied by the modifying letter. In yet another game variation, modification of a word may result in provisional capturing and blocking, wherein a competitor's rebuilding of the word would unblock the space occupied by his opponent's modifying letter (or letters), and permit use of these letters by the competitor (who rebuilt the word) to form words in directions which intersect the rebuilt word.

The preferred rotation mechanism 106 disclosed herein includes a platform portion 118 having separate base and upper platforms 120 and 122 with a ballbearing partition 124 disposed between them. While this arrangement is believed to provide the best rotating operation, alternative means for rotating a gameboard 100 may be provided while maintaining the basic features of the inventive rotation mechanism 106. For example, the platform portion 118 may comprise a single platform with a no-friction upper surface (e.g. Teflon TM) to permit sliding rotation between gameboard 100 and the low-friction surface. By combining such a simplified platform portion with appropriate connection and locking members, a folding gameboard 100 may be locked in an unfolded position and rotated relative to the stationary platform portion, while maintaining a desired degree of compactness in the rotation mechanism.

Connection members, which are illustrated above in terms of a bolt 128 and knob 130, need not be limited to the threaded fasteners of the preferred embodiment. Various types of fasteners may be used for connecting gameboard 100 to platform portion 118, to prevent the board 100 from buckling at seam 127 in an inverted V-shape in response to downward pressure. For example, a ball-lock pin may be inserted through aperture 127 in gameboard 100 and into a suitably shaped receiving aperture in the platform portion 118, to provide the necessary connection of the board to the platform portion. Cooperative snapping fasteners may also be used, one of which is incorporated in the platform portion 118. Further, the connecting member or members may be integral with the platform portion 118 and/or with gameboard 100, eliminating the necessity for separate pieces such as knob 130.

It may also be appreciated that the gameboard locking member, which is discussed above as a flat plate 134, may assume any shape consistent with its function of distributing the pressure of knob 130 over sections 132 and 133 of gameboard 100 as described above. It may also be integrated with a connection member or members, when it is desired to reduce the number of separate board stabilizing elements.

From the above description it will be apparent that the subject matter of this invention is capable of taking various useful forms, and it is intended, therefore, that this disclosure be taken in an exemplary sense and the scope of protection afforded be determined by the appended claims.

What is claimed is:

1. A method of playing a game for a plurality of competitors, using an apparatus having means defining a plurality of playing spaces in a grid shaped pattern and means defining a plurality of distinguishable sets of alphanumeric character-representing elements, each element dimensioned for placement within one of said playing spaces, so as to be useful for forming words within said grid shaped pattern, said method comprising:

assigning one of said distinguishable sets of elements to each competitor for manipulation into words in achieving a level of accomplishment characterized by a score;

executing a sequence of playing phases in which said competitors take turns at building words in said grid shaped pattern and then expanding said words into new words, said sequence of playing phases followed by a terminating scoring phase comprising determining a value for each scorable word depending on its structure, and determining each competitor's score by combining the values of only those scorable words which end in one of his elements and were not further expanded;

said scorable words comprising all words which are used in determining any competitor's score.

2. A method as in claim 1, wherein said sequence of playing phases comprises executing at least one word-building phase followed by at least one offensive phase;

said word-building phase comprising at least one competitor manipulating elements from his respective set to build words until a predetermined first condition occurs;

said offensive phase comprising at least one other competitor, defined as said one competitor's opponent, modifying at least one word previously built by said one competitor to capture its score, said offensive phase continuing until a predetermined second condition occurs, said modifying of a word comprising a competitor's opponent placing at least one of his respective elements, defined as a modifying element, adjacent to a word built by the competitor, so as to expand the same into a new word, defined as a modified word.

3. A method as in claim 2 wherein said subsequent phases include a series of word-building and offensive phases prior to said terminating scoring phase, said word-building phases further comprising at least said one competitor manipulating elements from his respective set to rebuild at least one word previously built by him and modified by said one competitor's opponent, said rebuilding of a word comprising a competitor placing at least one of his respective elements adjacent to a modified word on his respective word-building structure, so as to expand the same into a new word, defined as a rebuilt word.

4. A method as in claim 3 wherein said offensive phases further comprise at least said one competitor's opponent remodifying at least one word previously rebuilt by said one competitor, said remodifying of a word comprising a competitor's opponent placing at least one of his respective elements adjacent to a word rebuilt by the competitor, so as to expand the same into a new word, defined as a remodified word.

5. A method as in claim 4 wherein said words are formed in intersecting arrangements of said elements.

6. A method as in claim 5 wherein each competitor has a word-building structure of predefined shape on said grid-defining means, and said manipulation of elements during said word-building phases is performed by said competitors within their respective word-building structures.

7. A method as in claim 6 wherein each of said word-building phases is performed by all competitors simultaneously.

8. A method as in claim 7 wherein each of said offensive phases is performed by all competitors simultaneously.

9. A method as in claim 8 wherein said modifying element, used by a competitor's opponent to modify the competitor's word, blocks the formation of scorable words by the competitor which intersect said modified word at said modifying element.

10. A method as in claim 9 further comprising the step of alternating said word building phases and offensive phases until at least one of a set of predetermined conditions occurs.

11. A method as in claim 10 wherein one of said set of predetermined conditions comprises one of said competitors signaling the start of a final phase after he has placed more than a predetermined number of his playing pieces in said word-building structures, said final phase further comprising the step of:

performing a last word-building phase, responsive to said signaling of said final phase, in which said competitor who signals the start of said final phase does not participate.

12. A method as in claim 10, wherein said terminating scoring phase is executed after the occurrence of one of said set of predetermined conditions, and said word value determining step comprises assigning a base scoring value to each scorable, non-modified word, based on the composition of said word.

13. A method as in claim 12 wherein said word value determining step further comprises assigning a base scoring value to each scorable word based on the composition of said word.

14. A method as in claim 13 wherein said word value determining step further comprises increasing the base scoring value of each scorable word which includes more than a predetermined number of elements, thereby defining a modified base scoring value.

15. A method as in claim 14, wherein said scoring phase further comprises increasing the scoring values of all scorable words which were modified and not subsequently rebuilt.

16. A method as in claim 15 wherein said predetermined first condition of said at least one word-building phase comprises the ending of a predetermined time period measured from the start of said word-building phase.

17. A method as in claim 10 wherein said word-building structures each comprise a substantially pyramid-shaped grid structure and, wherein said intersecting arrangements comprise linear arrangements in the horizontal, vertical and diagonal directions relative to the base of one of said pyramid structures.

18. A method as in claim 16, wherein said scorable words further do not include words which intersect a modified word at a modifying element and which do not end on said modifying element.

19. A method as in claim 18 wherein at least said one competitor is defined as said other competitor's opponent, and at least one of said offensive phases further comprises said other competitor's opponent modifying at least one word previously built by said other competitor to capture its score.

20. A method as in claim 19, wherein each of said offensive phases comprises said other competitor's opponent modifying at least one word previously built by said other competitor to capture its score, whereby said one competitor and said other competitor act exclusively as mutual opponents during said offensive phases.

21. A method for manipulating alphanumeric character-representing elements by a player to achieve a level of accomplishment characterized by a score, said method comprising:

providing a set of said alphanumeric character-representing elements and a substantially pyramid-shaped grid defining a word-building structure having a plurality of playing spaces each adapted to receive one of said elements; and building intersecting words in said structure by arranging a plurality of said elements in a corresponding plurality of playing spaces in the horizontal, vertical and diagonal directions with respect to the base of said pyramidal structure, each word having a base scoring value determined by the structure of said built word.

22. A method as in claim 21 further comprising increasing the base scoring value of a built word if the number of elements in said word exceeds a predetermined number.

23. A method as in claim 21 wherein said elements are arranged to form scorable words in the vertical direction reading from top to bottom, the horizontal direction reading from left to right, the diagonal direction reading upwardly from left to right, and the diagonal direction reading downwardly from left to right, said directions determined relative to the base of said pyramidal structure.

24. A method of playing a game for a plurality of competitors, using an apparatus having means defining a plurality of playing spaces in a grid shaped pattern and means defining a plurality of distinguishable sets of alphanumeric character-representing elements, each element dimensioned for placement within one of said playing spaces, so as to be useful for forming words within said grid shaped pattern, said method comprising:

assigning one of said distinguishable sets of elements to each competitor for manipulation into words in achieving a level of accomplishment characterized by a score;

executing a sequence of playing phases in which said competitors take turns at building words in said grid shaped pattern and then expanding said words into new words, said sequence of playing phases comprising executing at least one word-building phase, followed in sequence by at least one offensive phase, followed in sequence by at least one additional word-building phase;

said word-building phases comprising at least one competitor manipulating elements from his respective set to build words in intersecting patterns of said elements until a predetermined first condition occurs, each of said built words having a scoring value depending on its structure;

said offensive phase comprising at least said one competitor's opponent modifying at least one word previously built by said one competitor, said offensive phase continuing until a predetermined second condition occurs;

said modifying of a word comprising a competitor's opponent placing at least one of his respective elements, defined as blocking elements, adjacent to a word built by the competitor so as to expand the same into a new word, defined as a modified word;

said sequence of playing phases followed by a terminating scoring phase comprising determining each competitor's score by combining the values of all scorable words ending on one of said competitor's respective elements;

said scorable words comprising all words used in determining any competitor's score, and not comprising words which intersect a modified word at a blocking element and do not end on said blocking element.

25. A method as in claim 24, wherein said elements are arranged to form scorable words in a vertical direction reading from top to bottom, a horizontal direction reading from left to right, a first diagonal direction reading downwardly from left to right, and a second diagonal direction reading upwardly from left to right.

26. A method as in claim 25 wherein each competitor has a word-building structure having a predetermined shape on said grid-defining means, and said manipulation of elements during said word-building phases is performed by each competitor within his respective word-building structure.

27. A method as in claim 26 wherein each word-building phase is performed by all competitors simultaneously.

28. A method as in claim 27, wherein each offensive phase is performed by all competitors simultaneously.

29. A method as in claim 28, further comprising the step of alternating word-building phases and offensive phases until at least one of a set of predetermined conditions occurs.

30. A method as in claim 29, wherein at least said one competitor is defined as said other competitor's opponent, and at least one of said offensive phases further comprises said other competitor's opponent modifying at least one word previously built by said other competitor.

31. A method as in claim 30, wherein each of said offensive phases comprises said other competitor's opponent modifying at least one word previously built by said other competitor, whereby said one competitor and said other competitor act exclusively as mutual opponents during said offensive phases.

* * * * *